US005976026A

United States Patent [19]

Erb

[11] Patent Number: 5,976,026

[45] Date of Patent: Nov. 2, 1999

[54] MEANS AND METHOD FOR TEACHING AND REINFORCING PROPER HITTING TECHNIQUES

[76] Inventor: George A. Erb, 2086 Cervato Dr., Camarillo, Calif. 93012

[21] Appl. No.: 08/953,505

[22] Filed: Oct. 17, 1997

[51] Int. Cl.[6] ..... A63B 53/16

[52] U.S. Cl. ..... 473/272; 473/270

[58] Field of Search ..... 473/218, 266, 473/270, 271, 272, 273, 269, 219, 548, 217

[56] References Cited

U.S. PATENT DOCUMENTS

| | | | |
|---|---|---|---|
| 3,638,950 | 2/1972 | Hyotlaine | 473/271 |
| 3,658,344 | 4/1972 | Kimble | 473/272 |
| 3,815,906 | 6/1974 | Hermo | 473/273 |
| 4,516,772 | 5/1985 | Stratton | 473/273 |
| 4,647,048 | 3/1987 | Welch | 473/272 |
| 5,037,094 | 8/1991 | Johnson | 473/272 |
| 5,076,580 | 12/1991 | Lang | 473/417 |
| 5,318,290 | 6/1994 | Sawyer | 473/217 |
| 5,810,673 | 9/1998 | Castleberry | 473/217 |

*Primary Examiner*—Sam Rimell
*Attorney, Agent, or Firm*—Terry M Gernstein

[57] ABSTRACT

Proper hitting techniques for baseball or for golf are taught and reinforced by forcing the hitter off balance if his or her foot placement, foot movement, or leg orientation are in error. A device includes a multipart base which has one part linearly adjustable with respect to the other parts, and another part angularly adjustable with respect to the other parts, as well as a back foot supporting element rotatably mounted on the base. The hitter is forced to stand on the back foot supporting element on the forefoot so his back foot heel is held off the ground. The device forces the user to pivot correctly during the swing, as well as forcing the user to stride and land his front foot on the device, also on the forefoot, to master this element in conjunction with the back foot pivot and swing of the bat. The device is amenable to use by both left and right handed hitters, and can be used in conjunction with both an open stance and a closed stance by either batter.

23 Claims, 9 Drawing Sheets

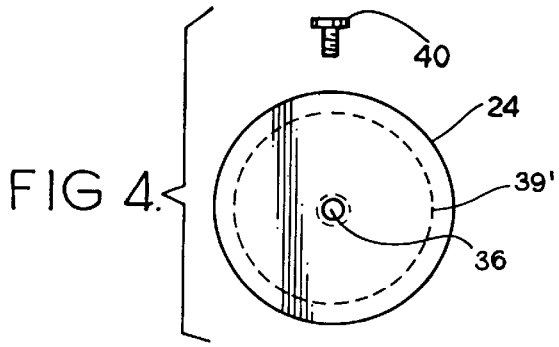
FIG 4.
FIG. 5.
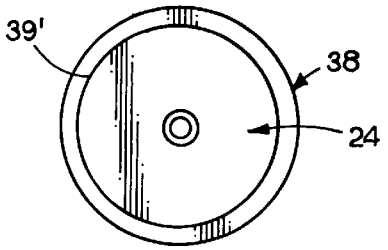
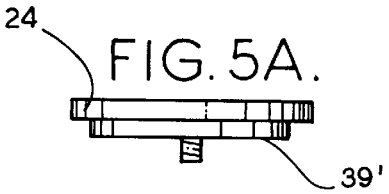
FIG. 5A.
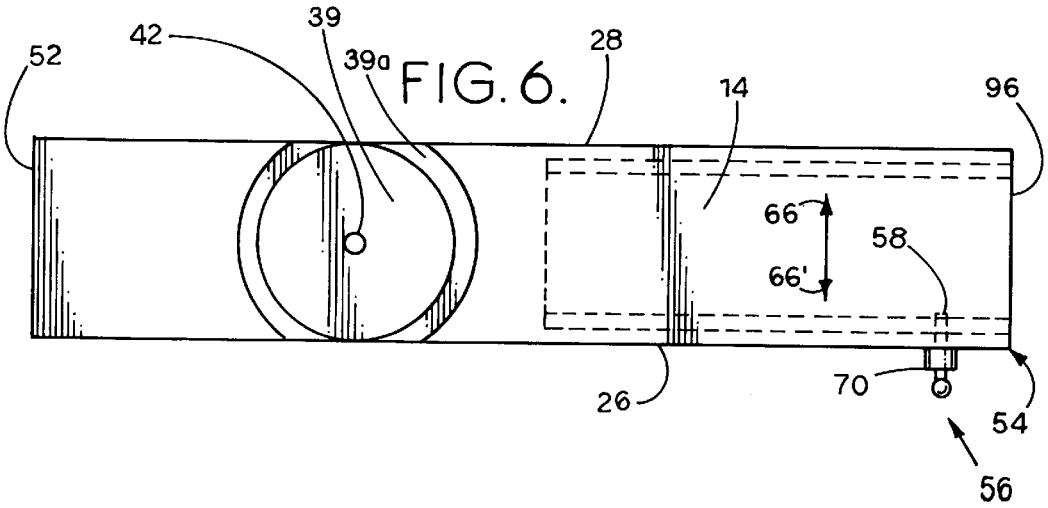
FIG. 6.

FIG. 11.
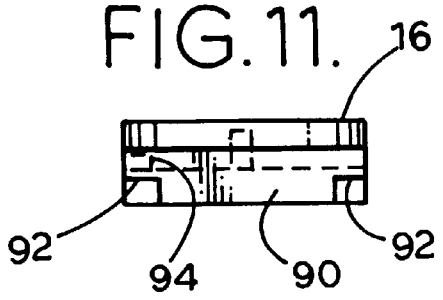
FIG. 12.
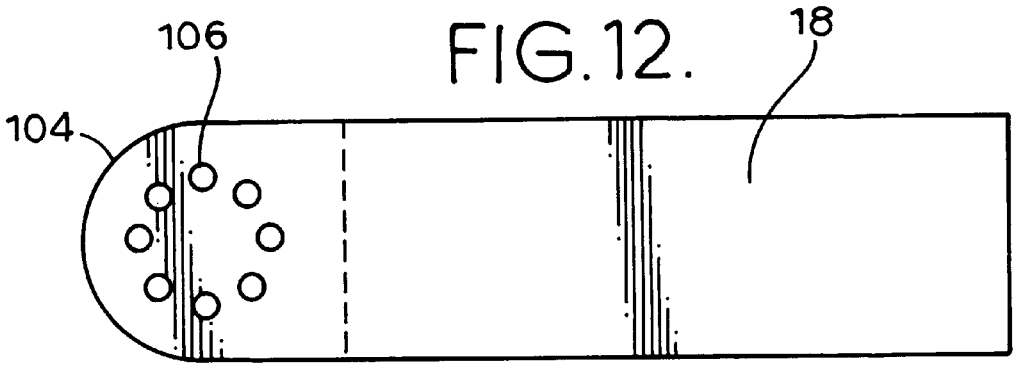
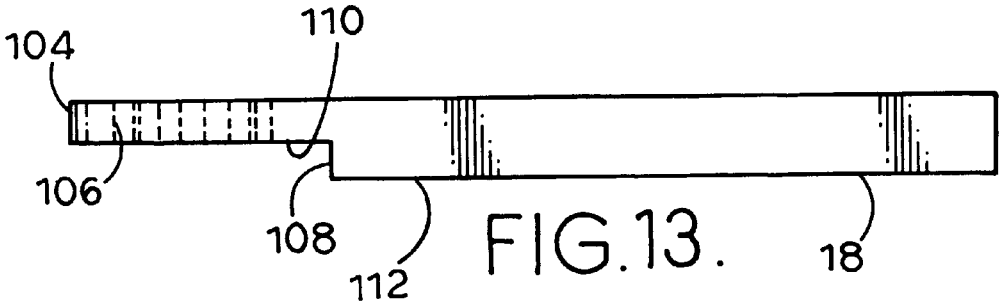
FIG. 13.
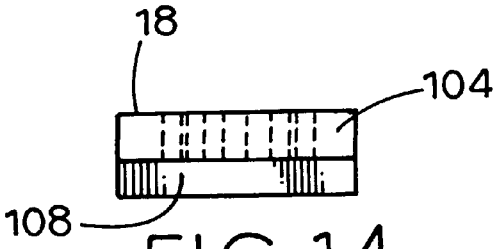
FIG. 14.

MEANS AND METHOD FOR TEACHING AND REINFORCING PROPER HITTING TECHNIQUES

TECHNICAL FIELD OF THE INVENTION

The present invention relates to the general art of amusement devices and games, and to the particular field of practice devices for teaching hitting, in games such as baseball or golf.

BACKGROUND OF THE INVENTION

In baseball, as in any other sport such as golf, in which a ball is struck, proper hitting technique is paramount. Without proper hitting technique, batted balls, if they are hit at all, will not go where the hitter intends. Proper hitting technique is therefore taught very early to someone learning the game.

Proper hitting technique involves many skills including certain lower body skills which include stance, stride and pivot, with swinging of the bat culminating as a result of proper sequencing and the balance associated with each of these skills. These skills can be further broken down to include the required actions and balance associated with hitting a ball such as a baseball or a golfball.

While all of these elements are important, it is the proper balance, stance, stride, pivot and swing that are of interest to this invention. More particularly, it is noted that without a proper stance, stride or balance, it is nearly impossible to have a proper swing. The inventor has observed that once a batter places his weight on the heel of his front or back foot, at any time during the stride or swing phase, he will lose his balance and fall/stumble in the direction either away from the pitcher or away from home plate and the strike zone. Therefore, teaching and reinforcing the proper stance, stride, pivot and balance will be the primary focus of this invention.

For purposes of this disclosure, the following definitions apply: "Forefoot" is generally known as the "ball of the foot" and is the forward half of the foot where the toes are joined at the knuckles (which lie between the long arch of the foot and the toes); "Rear foot" is the posterior remaining half of the foot . . . essentially the heel of the foot; "Front Foot" is the hitters left or right foot, whichever is closest to the pitcher in baseball, also known as the "stride foot;" "Back Foot" is the hitter's right or left foot, whichever is farthest away from the pitcher in baseball . . . also known as the "pivot foot."

The proper lower body movement associated with hitting a baseball can be broken down into the following stages: the initial stance assumed while waiting for a pitch (with the batter's weight moved onto each forefoot and his knees slightly bent); the foot movement and placement of the front foot in striding toward the pitcher/ball; back foot pivot on its forefoot, causing the hips/pelvis to turn toward the pitcher; and follow through as the swing is completed. Balance is paramount and necessary with each stage. If balance or foot placement and/or foot movement is wrong during any of these stages the swing will be affected, and of course, if the ball is struck at all, the ball is not likely to go where the batter wants.

Therefore, there is a need for a practice and teaching device that is particularly directed to baseball, but which can be used in teaching golf, which teaches proper hitting technique, and specifically proper balance, stance, and foot placement and movement prior to, during and after a swing.

With regard to proper foot placement, the inventor has observed that if the proper stance is not assumed before the swing is initiated, a desired result is not likely. For example, the batter in baseball should assume a stance with his head properly aligned if he or she expects to swing properly. Still further, the inventor has observed that striding toward the pitcher allows the batter to transfer all of his energy and momentum into the pitched ball, thus hitting it harder. Still further, proper stance and stride prevents the batter from swinging from his heels, thereby allowing more power to be directed to the swing. The batter should also have the proper stance while waiting for a pitch so he or she is prepared to hit the ball when and where desired. Thus, a batter may feel more comfortable with an open stance for one pitcher or game situation and a closed stance for another pitcher or different game situation. The batter should also have proper stride length and proper landing technique to further transfer power to the hitting stroke, maintain balance and proper visual contact with the ball.

The inventor has also observed several other elements of proper hitting technique that should be taught and reinforced if a hitter, such as a batter in baseball, is to be trained and reinforced in the proper manner. For example, proper back foot pivot before the swing causes proper back knee flexion (bending). This allows the batter to develop additional power and bat speed as well as to gain further access to balls that are pitched lower down in the strike zone. The inventor has also observed that many novices tend to land too hard after striding into the pitched ball which tends to disrupt their balance and remove power from their swing. The inventor has also observed that a hitter must stay on his or her forefoot of each of his or her feet from the start to the finish of the swing (i.e., when in the batter's box waiting for the pitch, the batter should be on his or her forefeet), if the proper swing is to be executed.

Still further, the inventor has observed that one of the most important aspects of a proper swing is balance. A hitter must maintain his or her balance during all phases and stages of batting if the result is to be desirable. Improper balance at any stage or phase can adversely affect the swing, and may not be remediable during the swing. In fact, most pitchers in baseball try to keep a hitter off balance, or at least cause the batter to lose some or all of his balance at some time during the pitch to adversely affect the swing process.

Still further, the inventor has observed that proper back foot movement requires a batter to move the heel of the back foot off the ground and then to pivot on the front part (forefoot) of the back foot. Proper movement of the back foot permits the hitter to position his or her body into a proper hitting position to properly hit a ball.

While the art does contain devices that are disclosed as teaching hitting, these devices do not teach the overall technique, and especially do not properly teach balance or use balance as a primary teaching tool so proper balance is constantly reinforced to the learner or to the user.

Still further, these known devices often do not teach the proper placement and movement of the feet prior to, during and after a swing. More specifically, these devices do not teach the proper stance for the batter's back foot. That is, while some control is exerted on the hitter by the prior art devices, they are deficient because they omit to require a stance and balance on the forefoot which causes the heel to be lifted prior to the pivot. Since proper back foot placement and movement is not taught by prior art devices, a batter may not learn a proper swing, and may even obviate proper initial stance teaching.

Therefore, there is a need for a baseball practice and teaching device that teaches and reinforces hitting in a complete manner whereby lower body placement, movement and balance during the entire swing is controlled.

Still further, since all batters do not have the same stance width and orientation, any device that is used to teach or reinforce proper lower body placement and movement during a swing should be able to account for this variation. Also, any such device must be able to account for both right handed and left handed hitters. This is particularly true for hitters who prefer an open stance or for hitters who prefer a closed stance.

Still further, the inventor has observed that many hitters like to warm up before a game, or even before a practice, by taking practice swings either at live pitching or at no pitching. Therefore, any device that is intended to teach or to reinforce proper hitting technique should be easily portable from one place to another, as well as be easily stored and set up.

As any hitter will attest, if one element of the swing is wrong, the entire swing is considered as deficient. Sometimes, one element will affect another more easily noticed element of a swing. Often, it is the more easily identified element which is the element corrected. This will be an error because the real culprit is not identified. This then creates additional problems and may result in an entire swing being affected and changed.

Still further, even professional batters develop bad habits. For example, there may be a lack of forefoot balance, a lack of proper back foot pivot and pelvic forward rotation, a lack of proper stride, or the like. These habits are often developed unknowingly or as a result of an attempt to correct another deficiency as discussed above, or as a result of injury or the like. However, developed, they can be highly detrimental and should be corrected. However, before they can be corrected, they must be identified. Prior art devices do not have the ability to identify such deficiencies.

Therefore, there is a need for a teaching device that identifies errors in a swing, especially lower body errors in a hitting technique.

OBJECTS OF THE INVENTION

It is a main object of the present invention to provide a device that teaches and reinforces basic hitting skills.

It is another object of the present invention to provide a device that teaches and reinforces lower body placements and movements during hitting a ball.

It is another object of the present invention to provide a device that teaches and reinforces balance during hitting of a ball.

It is another object of the present invention to provide a device that uses balance to teach and reinforce hitting skills.

It is another object of the present invention to provide a device that teaches and reinforces basic hitting skills by teaching and reinforcing proper foot placement and movement.

It is another object of the present invention to provide a device that teaches and reinforces basic hitting skills by teaching and reinforcing proper foot placement and movement before, during and after a swing.

It is another object of the present invention to provide a device that teaches and reinforces leg placement, position and movement during hitting.

It is another object of the present invention to provide a device that teaches and reinforces basic hitting skills in a safe manner.

It is another object of the present invention to provide a device that teaches and reinforces basic hitting skills and which is easily transported and stored.

It is another object of the present invention to provide a device that teaches and reinforces basic hitting skills and which can easily be adjusted to meet the particular needs of the individual user.

It is another object of the present invention to provide a device that teaches and reinforces basic hitting skills and which can be used by either a left handed hitter or by a right handed hitter.

It is another object of the present invention to provide a device that teaches and reinforces basic hitting skills and which can be used by either a left handed hitter or by a right handed hitter, with either an open or a closed stance.

It is another object of the present invention to provide a device that teaches and reinforces basic hitting skills and which readily and immediately identifies deficiencies in a swing.

It is another object of the present invention to provide a device that teaches and reinforces basic hitting skills and which readily and immediately identifies deficiencies in a batting swing.

It is another object of the present invention to provide a device that teaches and reinforces basic hitting skills and which readily and immediately identifies deficiencies in a hitter's lower body's contribution to the act of a batting swing.

SUMMARY OF THE INVENTION

These, and other, objects are achieved by a device that teaches and reinforces lower body placements and movements during a hitting stroke and which can be used as a basic teaching tool or by a skilled hitter to practice and perfect his or her skills in a safe manner. The device uses the hitter's balance as the primary tool to teach and reinforce the skills so balance is developed and perfected along with the other desirable elements of the skill. Due to the structure of the device, if the hitter is off balance, he or she will have an immediate signal of such condition which will allow the hitter to learn and be able to correct the flaw that created the off-balance situation. In this manner, balance is used to alert the user that his or her foot placement is in error, or his or her foot movement is in error, or his or her leg orientation or movement is in error, or his or her weight is distributed in error, or the like. The device is separable so it can be disassembled and stored or transported, and can be easily adjusted to fit the particular needs of the individual use. The device can be used by both right and left handed hitters as well as by novices and professionals since it is easily adapted to the individual skills and needs of the user, and reveals errors or deficiencies in the batting technique of such immediacy, that even professionals can be helped by the device of the present invention.

The device of the present invention does not require the use of an instructor so it can be used at any time that is most desirable and suitable for the user. The device is safe therefore further alleviating the need for an instructor.

Specifically, the device of the present invention promotes and develops balance by facilitating forefoot stance weight balance on both feet, as well as proper stride direction, length of stride and the proper front foot landing for the stride. There is no space available to accommodate the entire forefoot and rearfoot and a platform of the device has a height which is adequate to cause the user to balance his or her weight in a forward position (toward the plate) lest he or she fall backward onto his or her heels. This is important because the platform causes this off-balance effect intentionally when not controlled by the user and therefore creates a body awareness for the proper weight balance and weight bearing feel on the forefoot when volitionally controlled by the user.

specifically, the device of the present invention is designed with a pivot disc which is used by the back foot. The pivot disc is level or even slightly below the surface of a stance platform and rotates freely over three hundred sixty degrees under varying levels of tension (higher tension for the adult/expert user, lower tension for a child/inexperienced user). The disc can only be properly rotated if one stands on it with his forefoot only, as to try to stand on it with the rear foot and pivot foot would cause the forefoot to impinge into the stance platform unless one were to lift the forefoot up, which would throw the hitter's weight totally off balance causing him to fall backward away from the plate. Conversely, it is desirable to have the weight of the hitter's back foot on the forefoot as this facilitates the hitter to lift his heel before and during the back foot pivot which causes the hitter's pelvis to rotate toward the pitcher and ball at the proper time (thus, no rear foot impingement could occur into the platform as the heel is already lifted up). The pivot disc allows a hitter to learn this concept of pivoting his back foot in a very direct and easy manner. As the pivot disc can be set to a low tension level, in effect, his back foot will pivot via his momentum in swinging alone, even if he isn't attempting to do so, thereby giving him the "feel" of this necessary skill while simultaneously requiring balancing half of his body on the forefoot of each foot. As this "feel" and skill is developed, higher tension can be easily introduced for further development of this skill. Great hitters in baseball and softball have this ability of controlling the lower half of their body, and in fact this is where most of one's power is generated. It is difficult to hit a ball hard and/or where desired when the hitter is off balance, on his heels or hasn't pivoted his or her back foot/pelvis.

As discussed above, head orientation during hitting is important because once the head changes its position in space, the view of the oncoming ball is altered and thus the swing may be off line. Even though head placement and orientation might be considered upper body training, it is observed that the device of the present invention allows a hitter to train and maintain his head on the same axis while swinging the bat as it was during his stance phase, because proper balance from the lower body has provided a strong base from which to hold one's head and is necessary for this to occur. Thus, using balance, the device teaches proper head position and orientation.

The device of the present invention allows a hitter to develop a proper soft landing of the stride foot, with the forefoot landing on the platform and not off of it. This eliminates the age-old problem of "stepping in the bucket" with the stride foot which takes the hitter effectively away from the pitched ball and the strike zone, thereby making proper contact with the ball improbable. By stimulating and facilitating the stride foot's forefoot return on the platform after striding, the hitter is now able to properly place his foot at an oblique angle with respect to the path of the pitched ball and not pointing toward the pitcher (which is accomplished if one's front foot rearfoot is also on the platform). There is prior art which utilizes barrier obstacles to prevent "stepping in the bucket" which may present a risk of injury. The device also helps a hitter learn how to keep his weight on the inside of his thighs, thus decreasing the amount of head movement during a swing.

The device of the present invention also develops a hitter's ability to properly align his stance position such that each foot is equidistant from the home plate while in the batter's box by providing a practice template that can be repeatably configured for a "neutral" stance. This is desirable as it allows the batter, who is first learning the skill, to do so in a neutral position, while also allowing him to stride directly toward the pitcher. Then, he or she can experiment with other stances as their skill develops. The device can be configured in a straight line toward the pitcher, thus the batter must stride toward the pitcher to remain in contact with the platform once the stride foot returns to the platform (otherwise he falls off and loses his balance). The device requires the hitter to be on his forefeet in order to balance on the platform during initial stance, and all through the swing phase.

The device of the present invention automatically teaches a soft stride landing. It also allows a novice to work on, or experiment with, various stride lengths to find the one that is best for him without need to continuously change the device and without encouraging overstriding which would cause him to lose his balance and alter the position of the head in space. The device also teaches and reinforces proper forward stride direction and allows the hitter to begin with an open, neutral, or closed stance and stride while all the time giving feedback to the hitter should the hitter "step in the bucket" because his front foot will simply come off the platform and learning will occur without risk of injury. It is important that a hitter be afforded the opportunity to learn various stance positions and forward strides from those positions without having to worry about injury and while staying balanced. All great hitters have this in common: superior balance during hitting. The platform of the device of the present invention has a rotation feature of its front component which allows the hitter to direct his stride either forward-neutral (parallel with home plate) or forward-closed (toward home plate), and can be used by either left or right handed hitters without having to move structural elements and adjust the placement of those structural elements. Furthermore, because the device of the present invention requires balance on the forefeet and because there is no impediment to back foot rotation, and because the platform is very narrow (making the front foot landing area small), the hitter will specifically be taught to make small strides in order to remain under control and balanced on the platform. This addresses the concept of landing the front foot softly after striding. Many batters, when learning the proper hitting techniques, have a tendency to land very hard after striding. The device of the present invention addresses this problem.

Furthermore, since the device of the present invention requires the hitter to stand on a narrow platform on his forefeet, the batter's heel must be lifted thereby causing plantarflexion of the ankle, and thus biomechanically, knee flexion (bending of the knees) will be facilitated to maintain the batter's balance over the platform. The elevated and narrow platform prompts the batter to assume a slightly flexed (bent) knees posture.

BRIEF DESCRIPTION OF THE DRAWING FIGURES

FIG. 4 is a top plan view of a rotatable disc used in the device to teach and refine back foot pivoting movement.

FIG. 5 is a bottom plan view of the rotatable disc.

FIG. 5A is a side view of the rotatable disc.

FIG. 6 is a top plan view of a first part of a platform included in the device.

FIG. 11 is an end elevational view of the second part.

FIG. 12 is a top plan view of a third part of the platform.

FIG. 13 is a side elevational view of the third part.

FIG. 14 is an end elevational view of the third part.

DETAILED DESCRIPTION OF THE PREFERRED EMBODIMENT OF THE INVENTION

Figure 1:
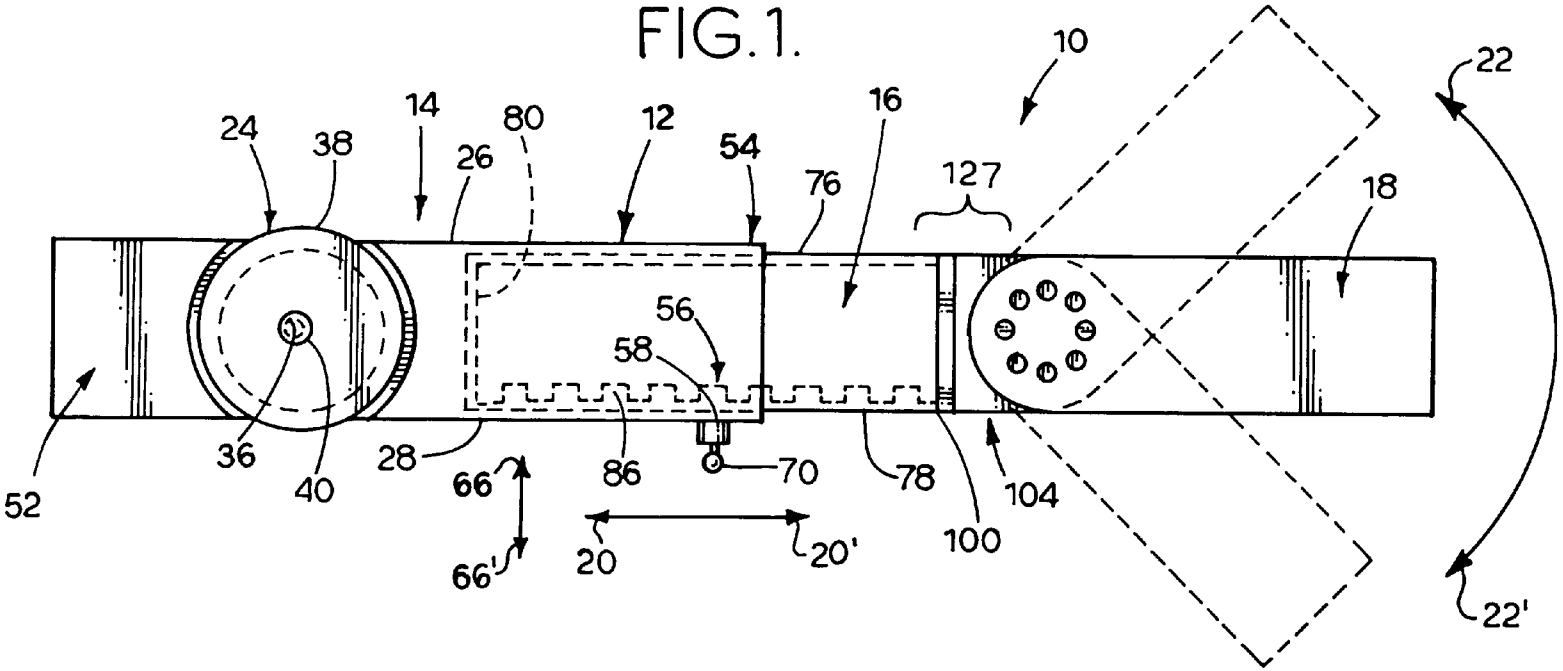
FIG. 1 is a top plan view of a device embodying the present invention.
Figure 1A:
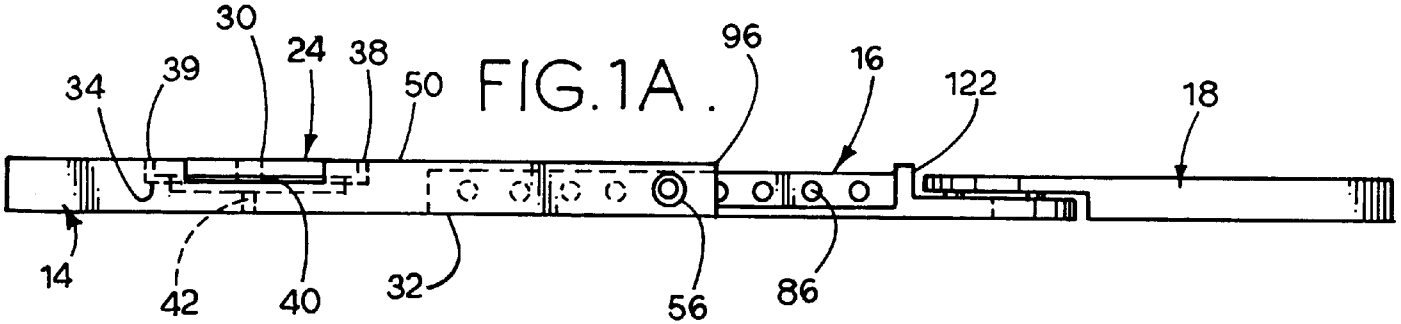
FIG. 1A is a side elevational view thereof.
Figure 2:
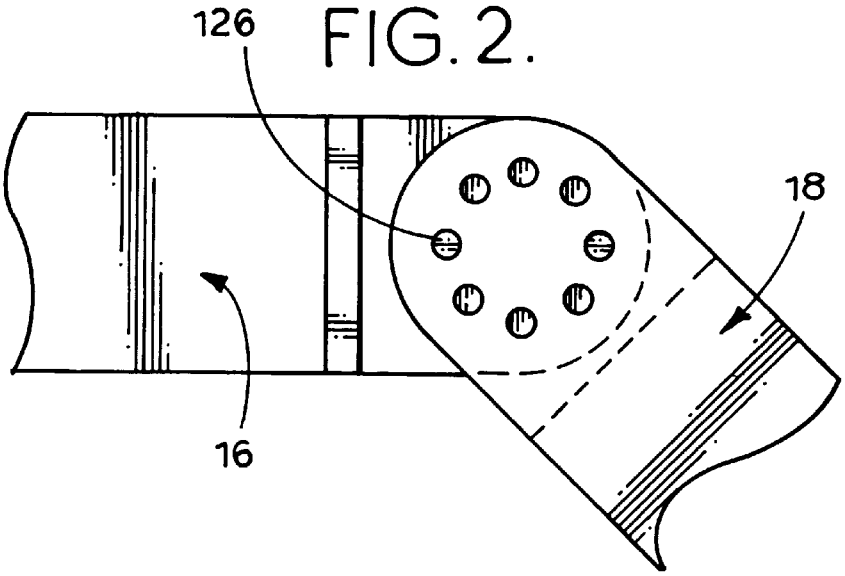
FIG. 2 is a top plan view of one portion thereof.
Figure 3:
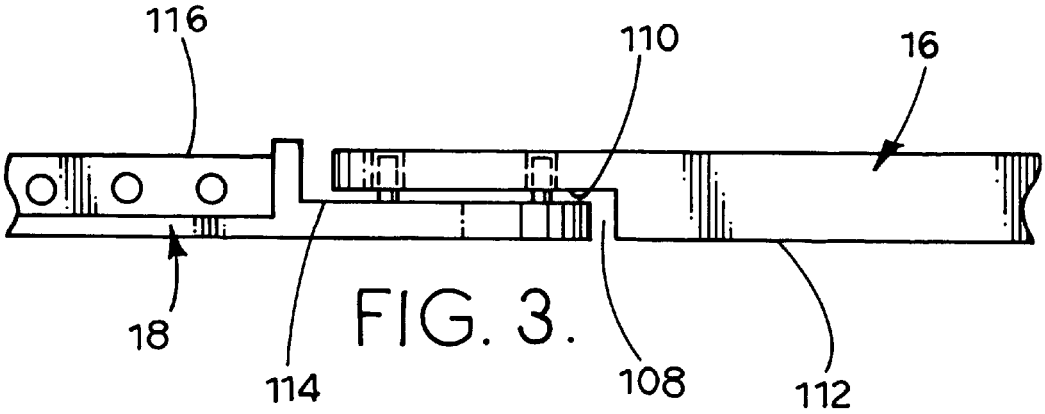
FIG. 3 is a side elevational view of the portion shown in FIG. 2.
Figure 7:
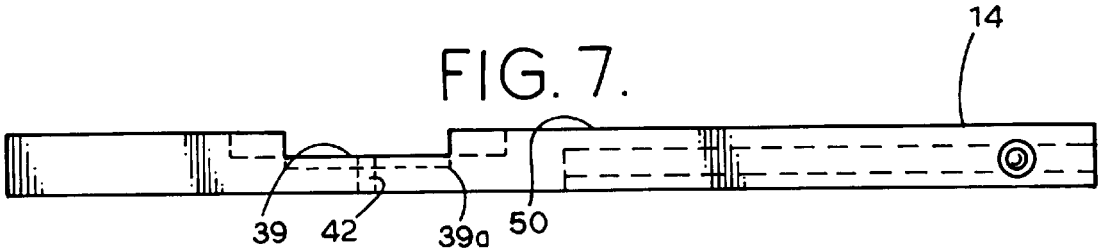
FIG. 7 is a side elevational view of the first part.
Figure 8:
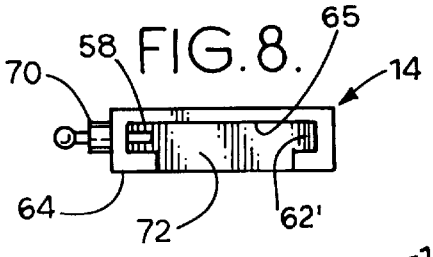
FIG. 8 is an end elevational view of the first part.
Figure 9:
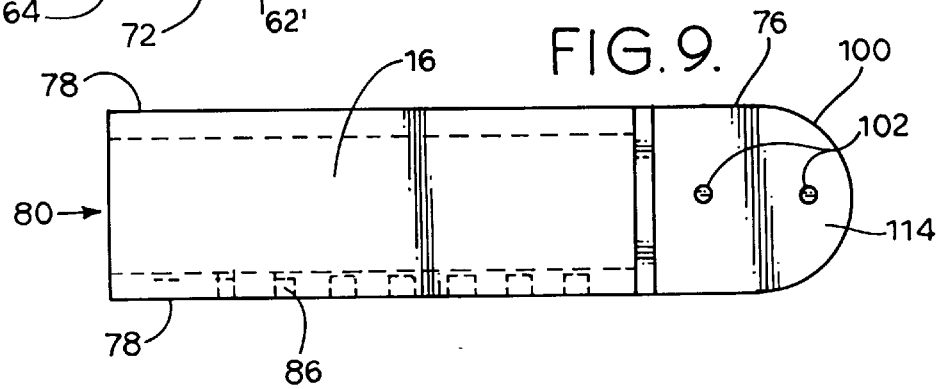
FIG. 9 is a top plan view of a second part of the platform.

Shown in FIGS. 1–3 is a first form of the device embodying the present invention. Device 10 includes a multipart platform or base 12 which includes three separable sections which are adjustable with respect to each other whereby device 10 can be customized for the particular individual needs of the user and can be knocked down for storage or transport. Base 12 includes a first part 14 for supporting the back foot of a user, a second part 16 which is connected to first part 14 to be adjustable linearly with respect to that first part, and a third part 18 which is connected to second part 16 to be adjustable angularly with respect to the second part and which supports the front foot of the user. Second part 16 is movable in directions 20 and 20' with respect to first part 14 to adjust stance width of device 10, and third part 18 is movable in directions 22 and 22' as indicated in dotted and solid lines in FIG. 1 to adjust stance and stride orientation and movement. Third part 18 can be moved from a negative angle of ninety degrees shown in FIG. 20 to a positive angle of ninety degrees and to any angle therebetween such as indicated in FIGS. 1 and 2 as desired. A disc 24 is rotatably mounted on first part 14 to be rotatable over 360 degrees with respect to first part 14.

In use, a hitter stands on platform 12 with the forefoot of his back foot resting on disc 24 and his forefoot of the front foot on second part 16. Third part 18 has been moved and located to be in the desired landing area for the front foot when the user executes a proper stride and swing. Second part 16 has been moved with respect to first part 14 in directions 20 and 20' to adjust the stance width and third part 18 is adjusted in directions 22 and 22' to accommodate the proper stride and landing. The user then stands on the platform, addresses the plate, strides and swings while keeping the forefoot portion of his back foot on disc 24, lifting his front foot as required, moving his front foot as required and stepping down onto part 18 which has been located to receive the front foot when a proper stride and plant has been executed. Platform 12 is narrow between side edges 26 and 28, in the preferred form the distance between edges 26 and 28 is approximately three and one-half inches, so the user must maintain his or her balance during the entire process. This balance is easily upset if the user establishes an erroneous stance before, during or after his swing, or misses a stride or a plant or moves his back foot wrong. Disc 24 is also only large enough to support the forefoot section of the user's back foot so, again, the user's balance is easily upset if he or she pivots wrong or improperly moves the back foot during the stance, stride and swing. The stride length is set by moving second part 16 linearly with respect to first part 14, and the stride direction is set by moving third part 18 angularly with respect to second part 16. In the preferred form of device 10, the distance between top surface 30 and bottom surface 32 is only about three-fourths of an inch, so even if the user falls off of the platform, there is virtually no danger of injury, yet is tall enough to require the batter to balance on his forefeet and receive immediate feedback if he or she loses balance and falls off the device.

Upsetting the user's balance in this manner forces the user to move in a manner that maintains his balance. This is a positive feedback for proper placement and movement and can be used to learn proper hitting techniques. The positive feedback is immediate and consistent and thus can be planned for by the user. This makes learning and refining hitting techniques accurate and repeatable.

Having described the broad device and its use, the details thereof will now be discussed.

Figure 21:
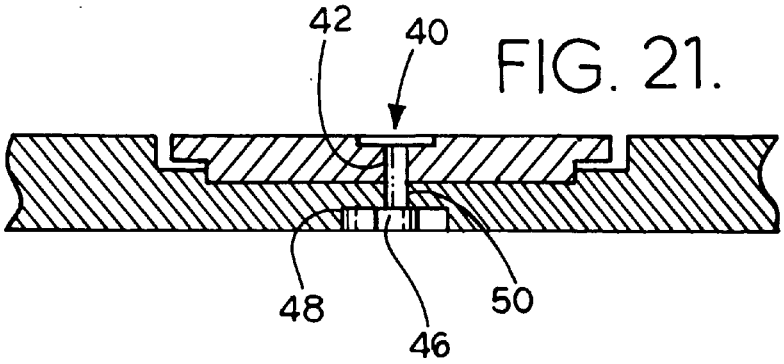
FIG. 21 is a side elevational view of one form of connection between the rotatable disc and the platform.

Referring to FIGS. 1, 2, 4 and 5, disc 24 is shown as including a top surface 30 and a bottom surface 34 with a pivot pin receiving hole 36 defined centrally therein and an outer periphery 38 having a diameter that is large enough to only securely support the fore foot of a user thereby forcing that user to lift his heel and thus keep himself properly balanced. A means for rotatably attaching disc 24 to part 14 includes a threaded fastener 40 which fits through hole 36 and is threadably connected to fastener receiving hole 42 defined in part 14. Fastener 40 can be tightened down as tight as desired to control the amount of force required to rotate disc 24. The tightening force between fastener 40 and disc 24 can be controlled by an alternative means shown in FIG. 21 in which head 44 of fastener 40 is located in a countersunk hole defined in disc 24 and a spring-like means, such as a torsion spring controlled threaded fastener receiving element 46 is used to control the force required to rotate disc 24. A torsion spring is located in pocket 48 and is mounted on part 14 and has one end connected to an internally threaded sleeve 50 which threadably receives fastener 40. The amount of tightening force applied to fastener 40 determines the amount of rotation resisting force exerted by the torsion spring on disc 24.

Disc 24 is received in pocket 39 and has a flange 39' received in beveled area 39A of part 14 to stabilize the disc, and outer perimeter 38 of disc 24 is spaced from part 14 so this disc can freely rotate with respect to part 14 yet is securely held in place. Furthermore, top surface 30 of disc 24 is co-planar with top surface 50 of part 14 as best indicated in FIG. 2.

As shown in FIGS. 1, 2, and 6–8, first part 14 includes a distal end 52 having disc 24 thereon and proximal end 54.

A means 56 is used to adjustably and releasably connect first part 14 to second part 16. Means 56 includes a plunger or pin 58 mounted on part 14 and having a body extending through side 28 into a groove 62 defined by lip 64 and bottom surface 65 of first part 14. Plunger 58 can be threadably attached to a wing nut 70 for movement into and out of groove 62 in directions 66 and 66'. Groove 62 is a companion to a groove 62' and defines, with groove 62', a sliding area 72 which slidably receives second part 16 as indicated in FIGS. 1 and 2.

As is best shown in FIGS. 1, 2 and 9–11, second part 16 includes first and second side edges 76 and 78 which are spaced apart a distance which permits proximal end 80 of part 16 to slidably engage part 14 in area 72 between lips 64 and bottom surface 65 so second part 16 can slide in directions 20 and 20' . Plunger-receiving recesses 86 are defined in edge 76 of part 16 to receive the distal end of plunger 58 as indicated in FIGS. 1 and 2 to lock part 16 to part 14 at the desired length orientation between these two parts. There are a plurality of plunger-receiving recesses 86 that are spaced apart from each other so several length settings are provided for the two parts 14 and 16. A central portion 90 is defined between two wing portions 92 and has a surface 94 thereon. The wing portions are slidably received between lips 64 and bottom surface 65 to slidably lock part 14 to part 16. The top surface of part 16 is nearly co-planar with top surface 50 of first part 14 so there is little likelihood that a user will trip over end 96 of part 14.

Figure 10:
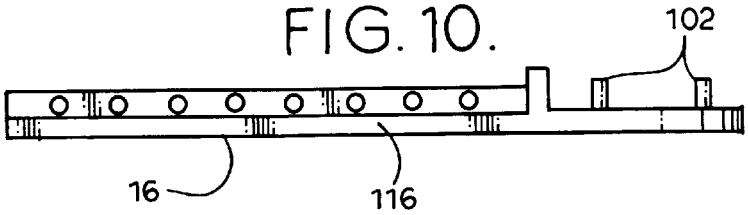
FIG. 10 is a side elevational view of the second part.

Distal end 100 of second part 16 is curved and two pins 102 are mounted on distal end 100 to extend upwardly therefrom as indicated in FIG. 10. The function and purpose of pins 102 will be understood from the following discussion.

Shown in FIGS. 1, 2, and 12–14 is third part 18 which is connected to second part 14 adjacent to the distal end 100. Third part 18 includes a proximal end 104 having a plurality of pin-receiving holes 106 defined therein in an arcuate pattern, preferably circular. Holes 106 are diagonally arranged to receive pins 102 to lock part 18 to part 16 in a desired orientation. A shoulder 108 is defined between surface 110 and bottom surface 112 of part 16 so that when pins 102 are received in holes 106, surface 110 slidably engages surface 114 of part 18 and the bottom surface of part 18 is essentially co-planar with the bottom surface of part 16 whereby the bottom surfaces of parts 14, 16 and 18 are all essentially co-planar with each other so the platform will lie flat on the ground. Any shoulder, such as shoulder 120 between parts 14 and 16 and shoulder 122 between parts 16 and 18 (see FIG. 2) is so small that it will not interfere with the operation of device 10.

Holes 106 and pins 102 are selected so a wide range of angular orientations between parts 16 and 18 can be selected, with an indicator 126 being shown in FIG. 2 on element 18 at connection 127 between parts 16 and 18 so a user can repeat his position settings as desired. As will be understood from this disclosure, since the joint between parts 16 and 18 is formed by pins being received in holes, any angular setting will be accurate and entirely repeatable. This makes training and refining associated with device 10 accurate and repeatable.

Use of device 10 is evident from the foregoing discussion, and thus will not be discussed. It is only noted that stance width is taught and refined by adjusting the connection between parts 14 and 16, and a landing location as well as stride length is taught and refined by adjusting the relative positions of parts 16 and 18. The movement of the hitter's back foot is taught and refined by adjusting the movement of disc 24. Thus, foot placement and movement throughout the entire swing can be taught and refined using device 10. As discussed above, since the device is narrow, if a foot is placed or moved in an erroneous manner, the user will fall off of the platform, thereby immediately indicating the error. Since balance is so important to a proper swing, and balance is what is used from an early age to learn certain skills (such as walking), a user quickly learns to adjust his or her foot placement and movement to execute a desired swing. Balance and gravity are known to be accurate and reliable teachers, and device 10 uses both balance and gravity to the most effective manner.

Further, as can be understood from the foregoing teaching, the device can be easily separated to be knocked down for storage or transport.

Figure 15:
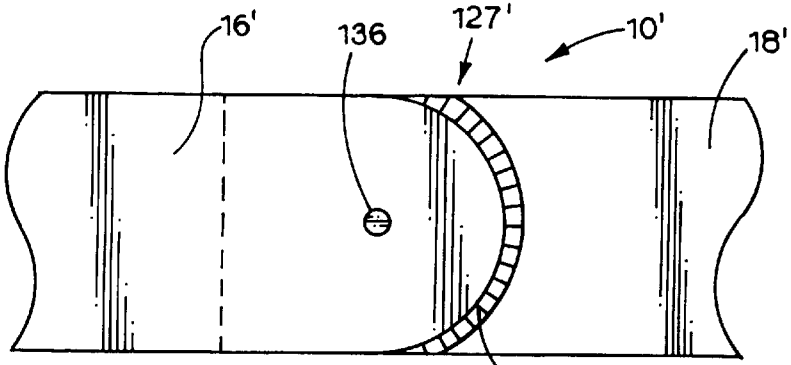
FIG. 15 is an alternative form of connection between the second and third parts of the platform.
Figure 16:
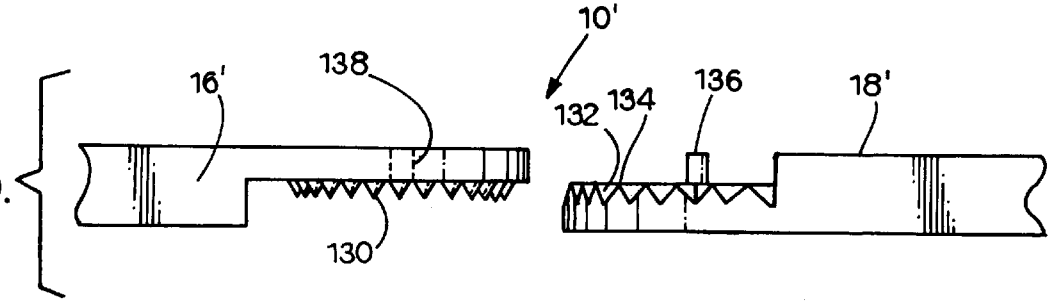
FIG. 16 is a side elevational view of the alternative connection with the two elements being separated.
Figure 17:
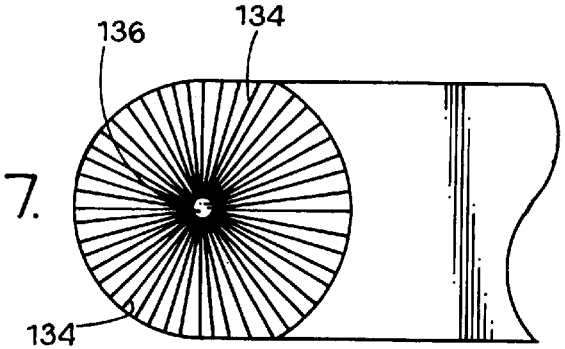
FIG. 17 is a top plan view of a third part of the platform using the alternative connection.

An alternative form of device 10 is shown in FIGS. 15–17 as device 10'. Device 10' includes a connection 127' between parts 16' and 18' that includes a plurality of projections 130 on part 16' and a plurality of projection-receiving grooves 132 on part 18' with grooves 132 being defined by projections 134 that radiate outwardly from a central post 136 which is received in a post-receiving hole 138 defined in part 16'. Angular orientation of part 16' with respect to part 18' is established by locating projections 130 in appropriate grooves 134.

Figure 18:
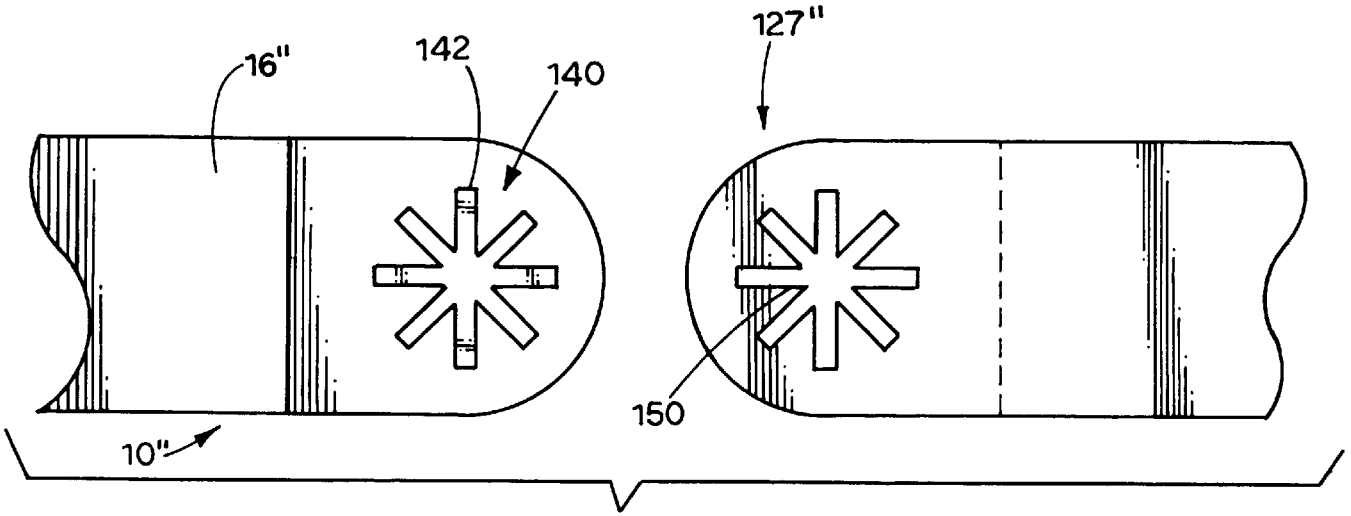
FIG. 18 shows a top plan view of another form of connection between the second and third parts of the platform.
Figure 19:
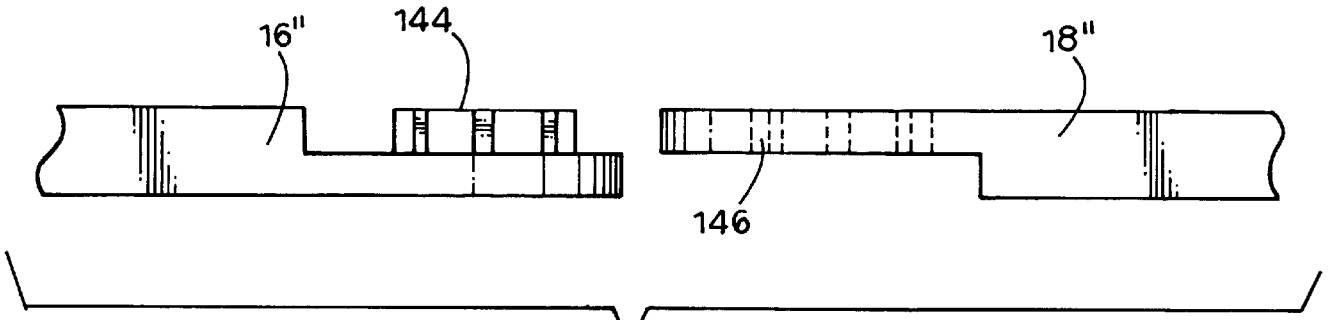
FIG. 19 is a side elevational view of the FIG. 18 form.
Figure 20:
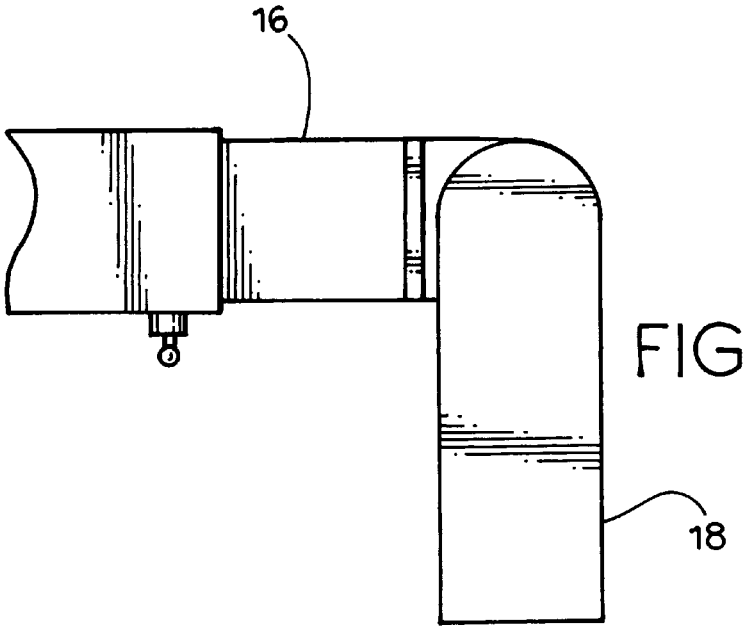
FIG. 20 is a top plan view of the second and third parts of the platform in a negative ninety degree angular orientation with respect to each other.

Another alternative form of device 10 includes connection 127" between parts 16" and 18". Connection 127" includes a star-shaped projection 140 on part 16" having a plurality of arms 142 radiating outwardly from a central hub 144 and with are received in grooves 146 defined in part 18". Grooves 146 radiate outwardly from a central hub 150 in a fashion corresponding to the shape and orientation of arms 142. As indicated in FIG. 18, grooves 146 are angularly spaced apart at fifteen degree increments so the angular orientation between parts 16" and 18", like the angular orientation between parts 16 and 18 and parts 16' and 18', can be adjusted in fifteen degree increments between a positive ninety degrees and a negative ninety degrees (such as shown in FIG. 20).

Alternative devices 10' and 10" operate in a manner similar to device 10, and thus the operation and use thereof will not be discussed.

Figure 22:
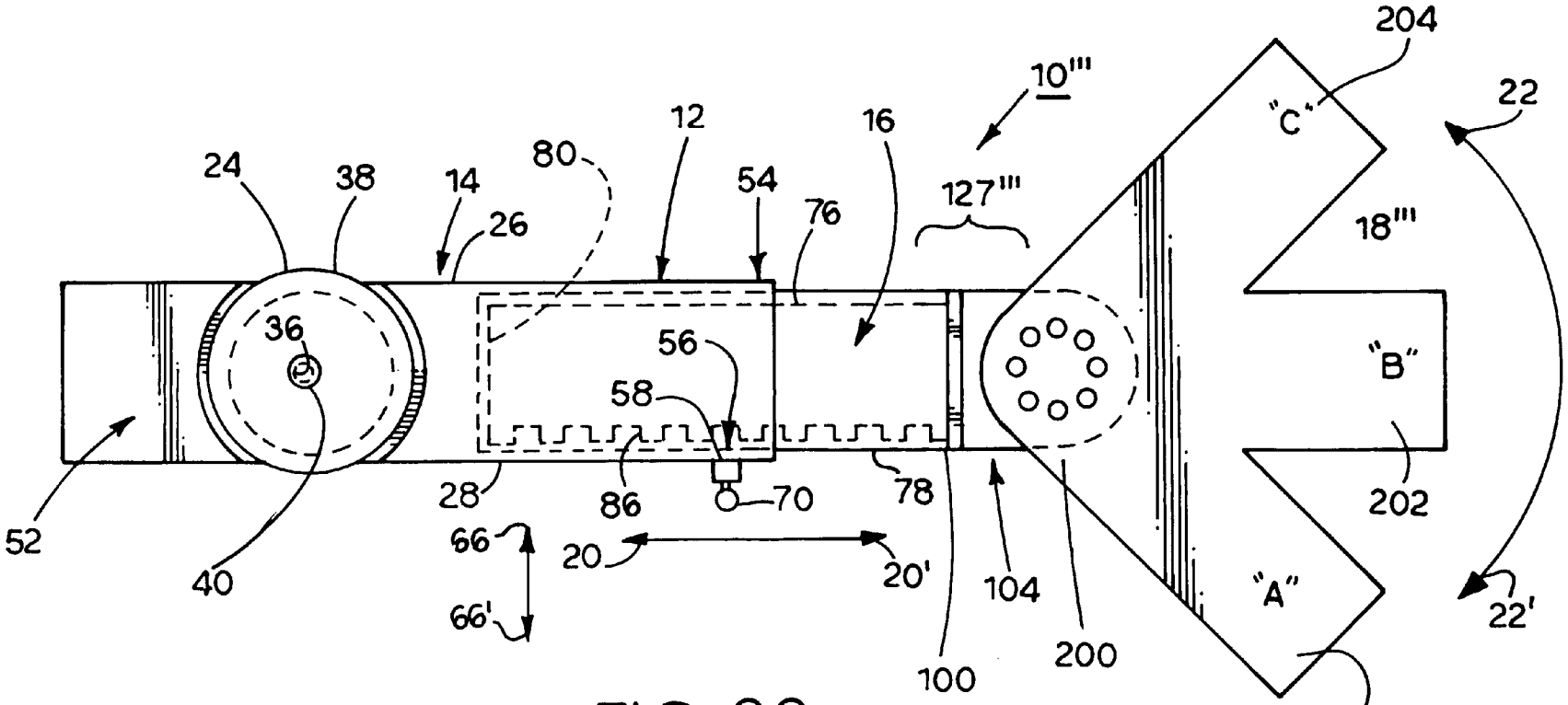
FIG. 22 is an alternative form of the device which can be used in conjunction with either an open or a closed stance.

As discussed above, the device should be able to accommodate various stride patterns, including a open stance as well as a closed stance for either a right-handed hitter or a left-handed hitter. Therefore, device 10'" shown in FIG. 22 includes a part 18'" that permits a batter to stand in an open or in a closed stance then to stride in a proper manner as discussed above. Thus, part 18'" includes a proximal end 200 attached to part 16 in a manner discussed above to be angularly adjustable with respect to the part 16 as indicated by arrows 22 and 22' . Part 18'" is a three prong element with proximal end 200 forming an apex. One prong 202 extends along a line that is linearly oriented with respect to part 16 and the rest of the base, and two other prongs 204 and 206 are each oriented at an angle with prong 202.

In use, device 10'" is set up in the desired configuration by adjusting part 16 with respect to part 14 and part 18'" is angularly set up using joint 127'" which is similar to the above-discussed joint 127. The batter can stand his front foot on prong 206 for an open stance and then stride his front foot to either prong 202 or prong 204 (for a left-handed hitter). Also, the batter can stand his front foot to either prong 202 or prong 206 (for a right-handed hitter). With device 10'", all of the above-discussed features are available and the additional feature of permitting an open or a closed stance to be learned, practiced and reinforced is available. Additionally, a open stanced hitter can start in an open stance and then stride into a closed or neutral stance as desired. The reverse is true if "stepping into the bucket" is desired. Balance and control are the same as discussed above in connection with the other embodiments of the invention.

It is understood that while certain forms of the present invention, such as a baseball practice and teaching device, have been illustrated and described herein as being the best mode of practicing the invention, it is not to be limited to the specific forms or arrangements of parts described and shown, and other forms, such as a golf practice and teaching device could be devised by someone skilled in the art without the practice of invention. Accordingly, it is understood that such additional forms are considered within the teaching of this disclosure.

I claim:

1. A baseball practice device for teaching and reinforcing hitting skills comprising:

A) a multipart base which includes
a first part for supporting a batter's back foot,
a second part adjustably connected to said first part, and
a third part adjustably connected to said second part for supporting the batter's front foot;

B) a back foot rear foot supporting plate rotatably mounted on said first part;

C) means for connecting said second part to said first part so said second part can be adjusted linearly with respect to said first part; and D) means for connecting said third part to said second part so said third part can be adjusted angularly with respect to said second part.

2. The device defined in claim 1 wherein said first part has a top surface and said plate has a top surface which is co-planar with and spaced from the top surface of said first part.

3. The device defined in claim 1 wherein the means for connecting said second part to said first part includes a plunger on said first part and a plunger-receiving recess defined in said second part.

4. The device defined in claim 3 further including a plurality of plunger-receiving recesses which are spaced apart from each other on said second part.

5. The device defined in claim 1 wherein the means for connecting said third part to said second part includes a projection on one part and a projection-receiving recess on the other part.

6. The device defined in claim 5 further including a plurality of projection-receiving recesses which are angularly spaced apart from each other.

7. The device defined in claim 5 wherein the second part has a top surface and said third part has a top surface which is coplanar with the top surface of said second part.

8. The device defined in claim 6 wherein said projection includes a plurality of arms.

9. The device defined in claim 8 wherein said arms radiate out from a common center.

10. A baseball practice device for teaching and reinforcing hitting skills comprising:

A) a multipart base which includes a first part for supporting a hitter's back foot and a second part adjustably connected to said first part on which the hitter steps to have his front foot received and supported during landing after the hitter executes a desired stride and swing;

B) means on said base for adjusting the relative positions of said first and second parts of the base to accommodate various stance widths;

C) means on said base for adjusting the relative positions of said first and second parts of the base for accommodating various stride patterns whereby the hitter's front foot will securely fall on said second part after the desired stride and swing are executed;

D) means on said base for guiding movement of a hitter's backfoot during a hitting stroke; and E) means for connecting said first and second parts together so said first and second parts can be moved linearly and angularly with respect to each other.

11. The device defined in claim 10 wherein the movement guiding means includes means for guiding and controlling placement of the hitter's back foot before, during and after the hitting stroke.

12. A practice device for teaching and reinforcing hitting comprising:

A) a base;

B) means on said base for adjusting the base to accommodate different hitter stance widths;

C) means on said base for guiding movement of the hitter's back foot during a hitting stroke;

D) said base having a portion on which the hitter's front foot steps after executing a swing;

E) means for adjusting the linear position and the angular orientation of said portion relative to said means for guiding movement of the hitter's back foot for knocking the hitter off balance if the hitting stroke is not executed in a desired manner thereby forcing the hitter to execute a desired hitting stroke in order to maintain proper balance before, during and after a hitting stroke.

13. The device defined in claim 12 wherein said balance means includes means for supporting the forefoot of the hitter's back foot.

14. The device defined in claim 13 wherein the means for supporting the hitter's forefoot includes means for supporting the forefoot during stance, stride and pivot phases of the hitting stroke.

15. The device defined in claim 14 wherein the means for supporting the hitter's forefoot includes a disc rotatably mounted on said base.

16. The device defined in claim 12 wherein the means for guiding movement of the hitter's back foot is movably mounted on said base and includes means for adjusting the movement thereof.

17. The device defined in claim 12 further including means on said base for adjusting the base to accommodate different orientations of the hitter's back foot relative to the hitter's front foot.

18. The device defined in claim 16 wherein the adjusting means includes a tension element.

19. The device defined in claim 12 wherein said base includes a plurality of sections and the sections are separable.

20. A baseball practice device for identifying lower body errors in hitting comprising:

A) a multipart base which includes
a first part for supporting a batter's back foot,
a second part adjustably connected to said first part, and
a third part adjustably connected to said second part for supporting the batter's front foot;

B) a back foot forefoot supporting plate rotatably mounted on said first part;

C) means for connecting said second part to said first part so said second part can be adjusted linearly with respect to said first part; and D) means for connecting said third part to said second part so said third part can be adjusted angularly with respect to said second part.

21. A baseball practice device for identifying lower body errors in hitting comprising:

A) a base which includes a first portion and a second portion which is movable linearly and angularly with respect to said first portion, said second portion being located and sized to securely support a hitter's front foot after the hitter seeps onto said second portion;

B) means on said base for adjusting said first and second portions of the base to accommodate various stance widths;

C) means on said base for adjusting said first and second portions for accommodating various stride patterns;

D) means on said base for guiding movement of a hitter's back foot during a hitting stroke; and E) said second portion being located and oriented relative to said first portion to knock the hitter off balance when the front foot steps on said second portion if the hitting stroke is not executed in a desired manner.

22. The baseball practice device defined in claim 10 wherein said means for accommodating various stride patterns includes means for accommodating an open stance and a closed stance.

23. The baseball practice device defined in claim 22 wherein said means for accommodating an open stance and a closed stance includes an element connected to said base and having three prongs, with one prong extending linearly with said base, and two prongs each oriented at an angle to said one prong.

* * * * *